US007854024B2

(12) United States Patent
Fang

(10) Patent No.: US 7,854,024 B2
(45) Date of Patent: Dec. 21, 2010

(54) ADJUSTABLE FITTING RING STRUCTURE

(76) Inventor: Kenneth Fang, 8F., No. 306, Sec. 6, Minchuan E. Rd., Neihu District, Taipei City (TW)

( * ) Notice: Subject to any disclaimer, the term of this patent is extended or adjusted under 35 U.S.C. 154(b) by 813 days.

(21) Appl. No.: 11/806,084

(22) Filed: May 30, 2007

(65) Prior Publication Data

US 2008/0295229 A1 Dec. 4, 2008

(51) Int. Cl.
*A42B 1/22* (2006.01)

(52) U.S. Cl. ..... 2/418; 2/417

(58) Field of Classification Search ..... 2/416–421, 2/410, 183, 195.1, 195.2, 195.4, DIG. 11, 2/88; 24/68 B, 68 R, 68 SK
See application file for complete search history.

(56) References Cited

U.S. PATENT DOCUMENTS 4,942,628 A * 7/1990 Freund ..... 2/416
5,950,245 A * 9/1999 Binduga ..... 2/417
6,314,588 B1 * 11/2001 Fang ..... 2/418
6,708,376 B1 * 3/2004 Landry ..... 24/68 R
7,000,262 B2 * 2/2006 Bielefeld ..... 2/418
7,043,772 B2 * 5/2006 Bielefeld et al. ..... 2/418
7,174,575 B1 * 2/2007 Scherer ..... 2/418
2005/0262619 A1 * 12/2005 Musal et al. ..... 2/421
2006/0225187 A1 * 10/2006 Wu ..... 2/425

* cited by examiner

*Primary Examiner*—Shaun R Hurley
*Assistant Examiner*—Andrew W Sutton
(74) *Attorney, Agent, or Firm*—Rosenberg, Klein & Lee

(57) ABSTRACT

An adjustable fitting ring structure includes a connecting base, a fitting ring, a guiding part, and an adjustable part. The connecting base has a receiving slot. There's a plurality of concave wedged slots on the receiving slot. The end portions respectively pass through the connecting base and each have a long slot. A gear portion is located in the long slot. The guiding part includes a base portion, a gear, and a plurality of flexible arms. Each of the flexible arms has a wedged body that contacts the wedged slot. The adjustable part is pivoted with the base portion to make the guiding part rotate so that the two end portions move in the same direction or in different directions. Thereby, the dimension of the fitting ring can be adjusted. It is easy for users to adjust the fitting ring. The structure is simplified and the assembly process is simple.

9 Claims, 7 Drawing Sheets

ADJUSTABLE FITTING RING STRUCTURE

BACKGROUND OF THE INVENTION

1. Field of the Invention

The present invention relates to an adjustable fitting ring structure. In particular, this invention relates to an adjustable fitting ring structure that is applied to a safety helmet and can be adjusted according to the wearer's head circumference.

2. Description of the Related Art

In order to protect themselves when they are driving a bicycle, riders need to wear safety helmets. Because safety helmets are not manufactured in a personalized manner, an adjustable fitting ring is added to the safety helmet. Therefore, the wearer can adjust the fitting ring to match their head circumference.

Reference is made to FIGS. 1 and 2. The adjustable fitting ring structure of the prior art includes a fitting ring 1*a*, a connecting base 2*a*, a guiding part 3*a*, and an adjustable part 4*a*. The fitting ring 1*a* has two end portions 11*a*. The upper side and the lower side of the two end portions 11*a* both have tooth portions 12*a*.

The connecting base 2*a* includes a first connecting part 21*a* and a second connecting part 22*a* that can connect together. The two side surfaces of the connecting base 2*a* each have an opening 23*a*. The two end portions 11*a* of the fitting ring 1*a* respectively pass through the two opening 23*a*. The tooth portions 12*a* are received in the connecting base 2*a*. A positioning convex block 211*a* protrudes from the connecting surface between the first connecting part 21*a* and the second connecting part 22*a*.

The guiding part 3*a* has a gear 31*a*. The gear 31*a* is connected with the tooth portion 12*a* of the fitting ring 1*a*. The guiding part 3*a* assembles with the first connecting part 21*a*.

The adjustable part 4*a* is connected with the guiding part 3*a* to rotate the guiding part 3*a*. The adjustable part 4*a* includes a gear disk portion 41*a*, a middle portion 42*a*, and a connecting portion 43*a*. These portions are assembled together in order. A plurality of cone gears 411*a* is disposed on the gear disk portion 41*a* in a radial direction. The cone gears 411*a* are connected with the convex block 211*a*.

However, the end portions 11*a* of the fitting ring 1*a* of the adjustable fitting ring structure of the prior art are geared with the upper side or the lower side of the gear 31*a* via the gear portion 12*a*. Therefore, the end portions 11*a* easily slip out and escape from the gear 31*a*. Unattended to, the gear 31*a* will not rotate smoothly.

Furthermore, the adjustable fitting ring structure of the prior art uses the cone gear 411*a* of the adjustable part 4*a* to contact the positioning block 21*a* of the connecting base 2*a* to position the adjustable part 4*a* and prevent the adjustable part 4*a* from rotating automatically. The adjustable part 4*a* makes the guiding part 3*a* rotate to change the dimension of the fitting ring 1*a*. After the adjustable fitting ring structure has been used for a long time, the cone gear 411*a* and the positioning block becomes worn, and the user feels uncomfortable when he or she adjusts the adjustable fitting ring structure.

Moreover, the quantity of elements required for the adjustable fitting ring structure of the prior art is large. The assembly process is complex, and the manufacturing costs are subsequently high.

SUMMARY OF THE INVENTION

One particular aspect of the present invention is to provide an adjustable fitting ring structure. The adjustable part can be rotated to change the dimension of the fitting ring. It is easy for the user to adjust the fitting ring. The structure is simplified and the assembly process is simple.

The adjustable fitting ring structure includes a connecting base having a receiving slot, a fitting ring having two end portions, a guiding part received in the receiving slot and pivoted on the connecting base, and an adjustable part located on one side of the guiding part and pivoted on the connecting base. Two sides of the receiving slot individually have an opening. The two openings link with the receiving slot, and there is a plurality of concave wedged slots disposed on the inner wall of the receiving slot. Each of the two end portions has a long slot. The upper side of the inner surface of the long slot located on the end portion has a gear portion, and the lower side of the inner surface of the long slot located on another end portion has another gear portion. The two end portions respectively pass through the openings, and are stacked in the connecting base. The guiding part includes a base portion, a gear, and a plurality of flexible arms. The gear is located on one surface of the base portion and extends into the two long slots. The two gear portions gear with the gear and are located on the two opposite sides of the gear. The surface of the outer edge of the flexible arm has a wedged body to contact and connect with the wedged slot of the receiving slot. The base portions bend and extend to form the flexible arms, and the flexible arms are disposed at the surrounding edge of the base portion at intervals. The adjustable part makes the guiding part rotate so that the two end portions move in the same direction or in different directions.

The present invention has the following characteristics. The adjustable part can be rotated to change the dimension of the fitting ring. It is easy for the user to adjust the fitting ring. The structure is simplified and the assembly process is simple.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
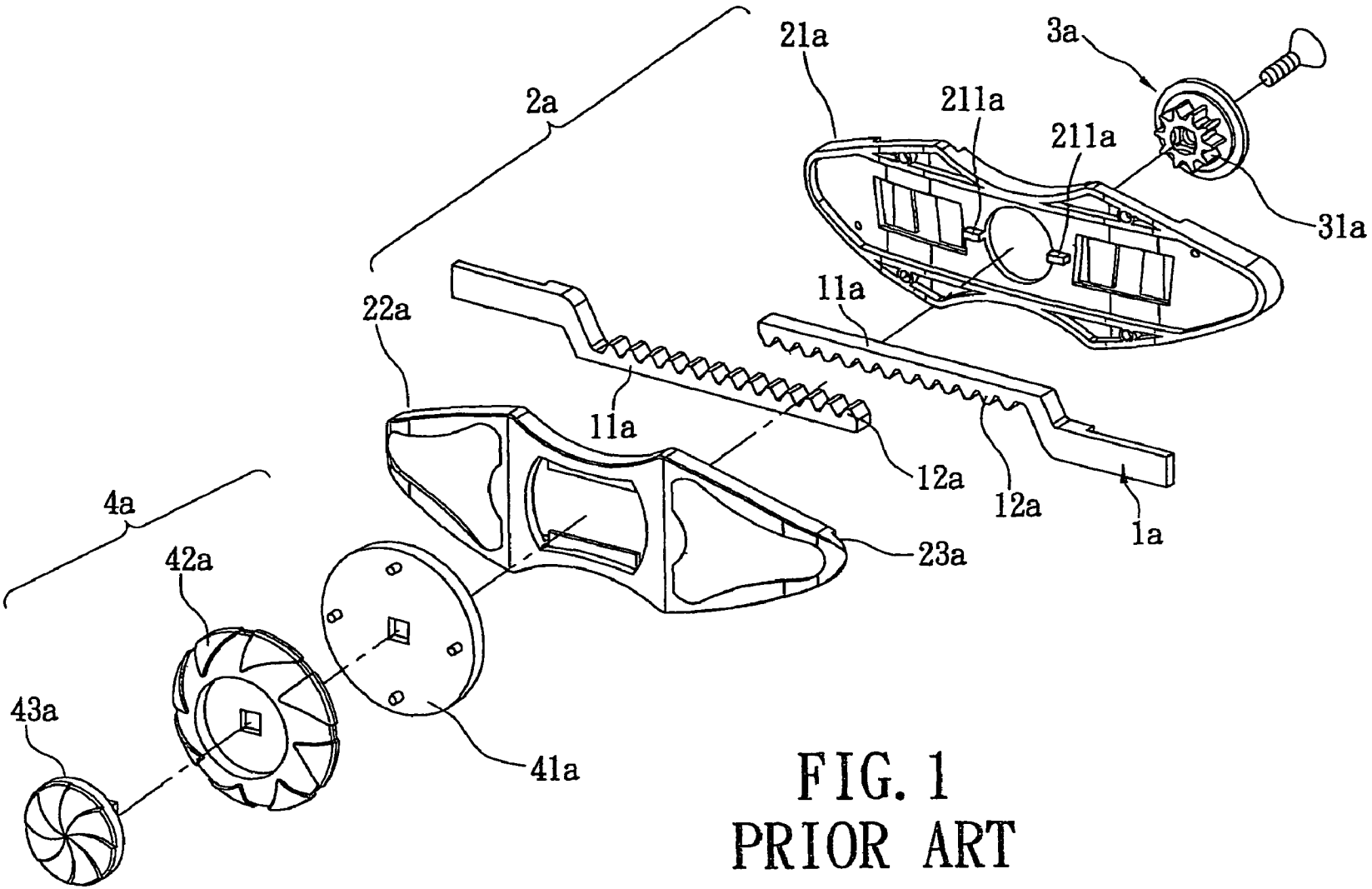
FIG. 1 PRIOR ART
FIG. 1 is an exploded perspective view of the adjustable fitting ring structure of the prior art.
Figure 2:
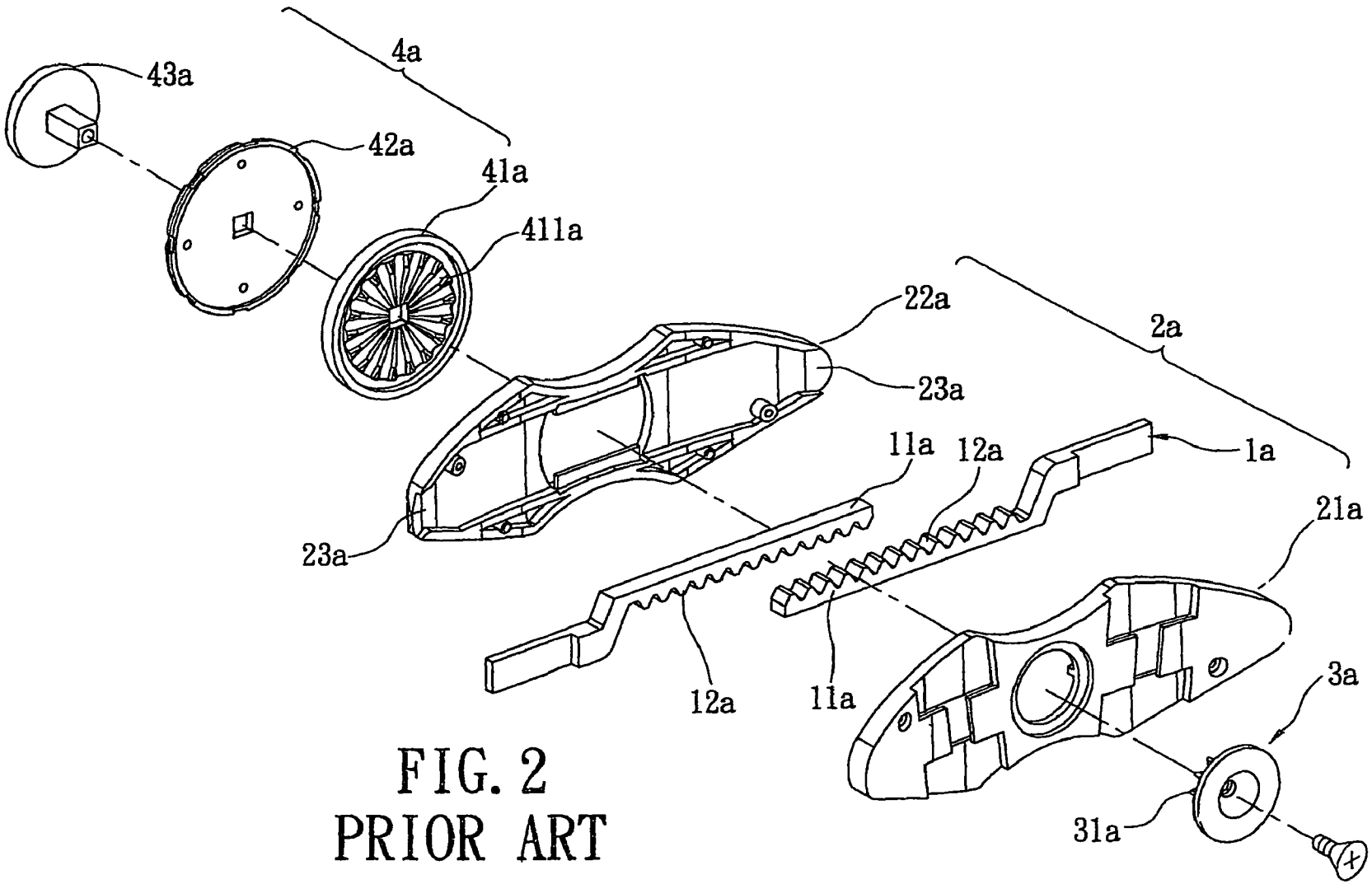
FIG. 2 PRIOR ART
FIG. 2 is another exploded perspective view of the adjustable fitting ring structure of the prior art.
Figure 3:
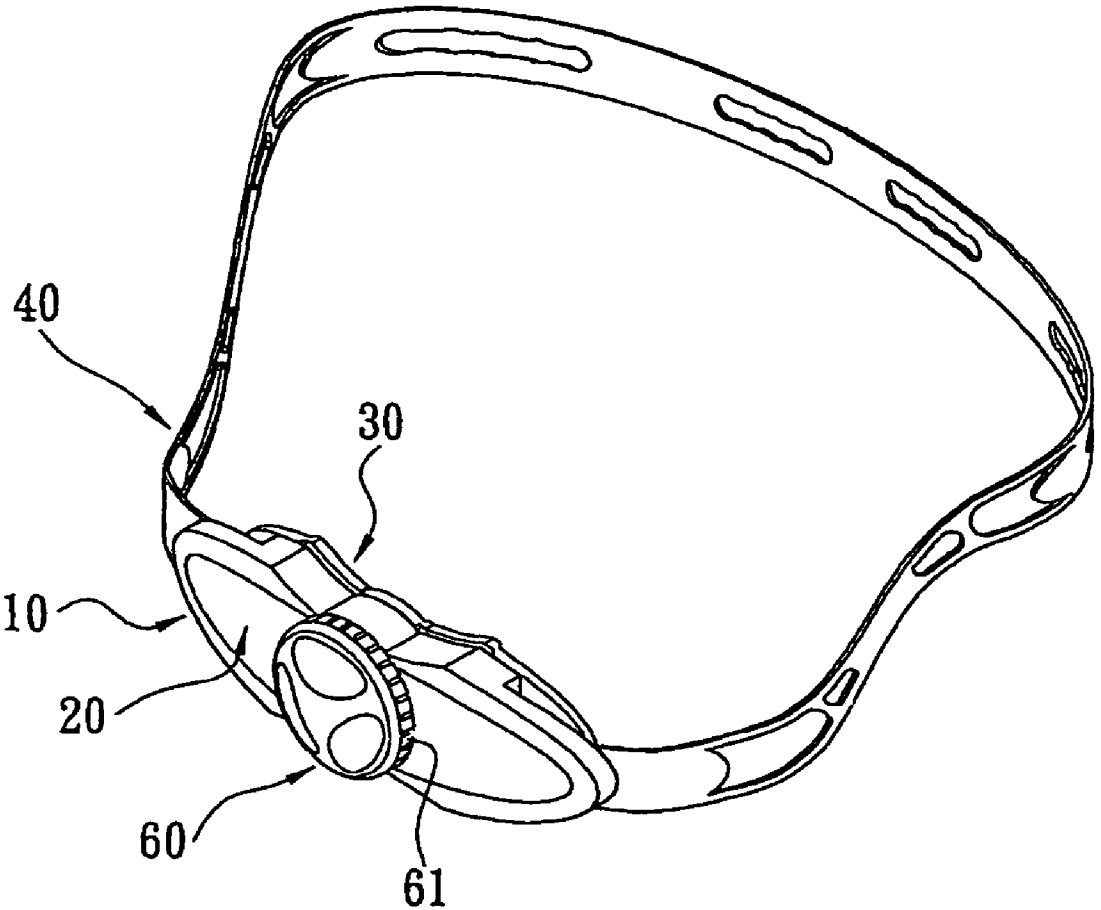
FIG. 3 is an assembly perspective view of the present invention.
Figure 4:
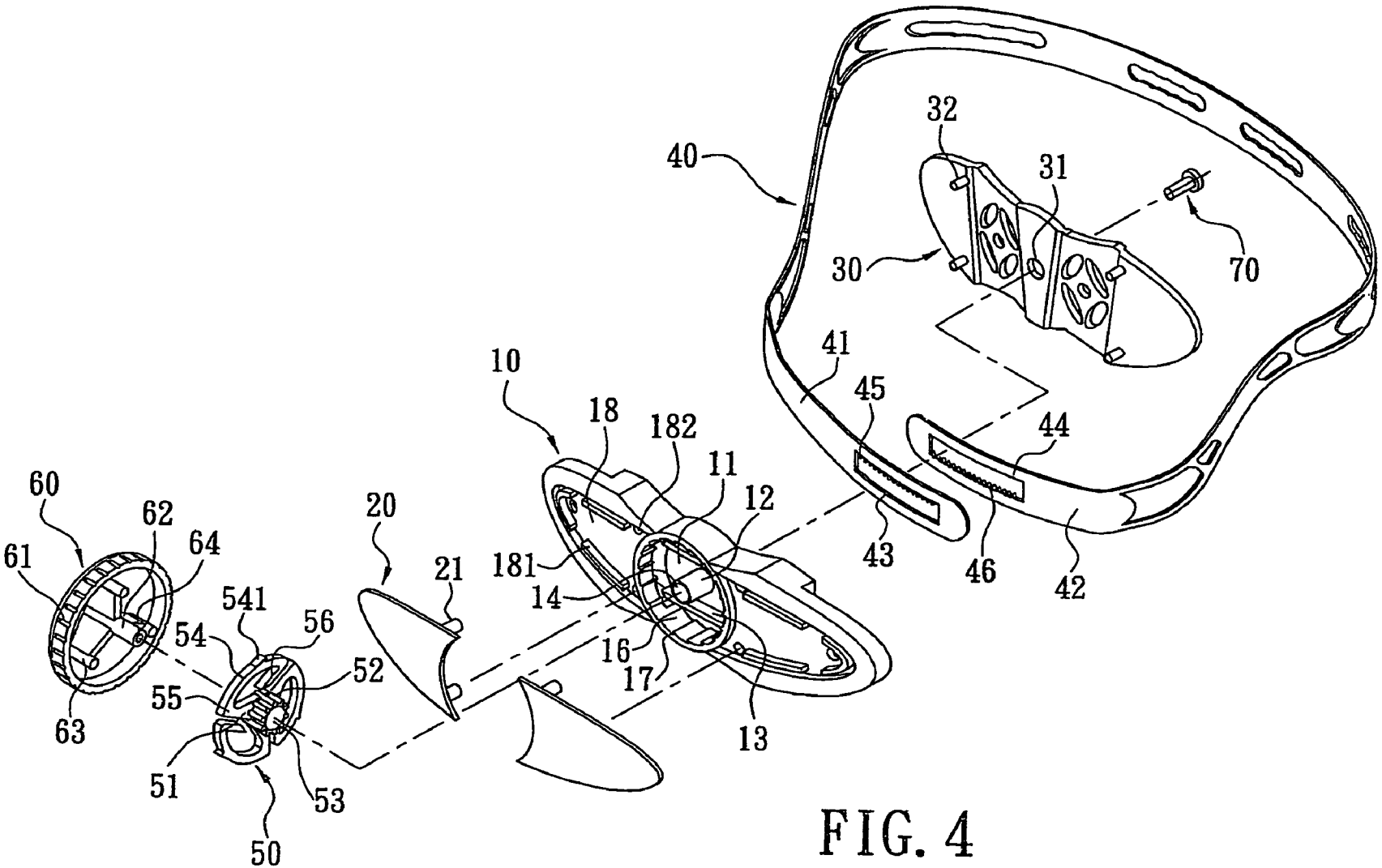
FIG. 4 is an exploded perspective view of the present invention.
Figure 5:
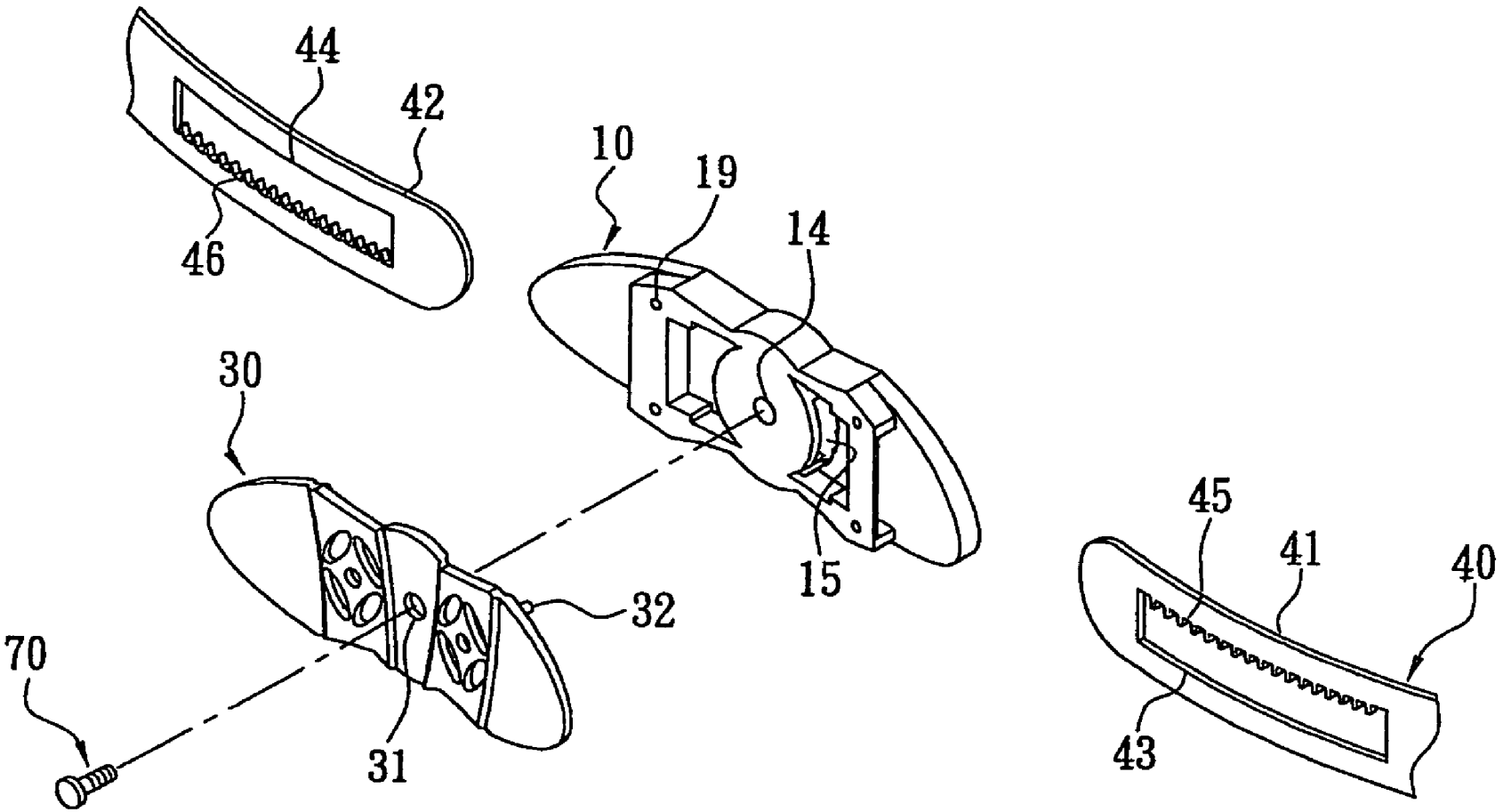
FIG. 5 is an exploded perspective view of part of the elements of the present invention.

Reference is made to FIGS. 3~5. The adjustable fitting ring structure includes a connecting base 10, two decorative boards 20, a cover board 30, a fitting ring 40, a guiding part 50, and an adjustable part 60.

At the center of the front surface of the connecting base 10, there is a receiving slot 11. A convex column 12 protrudes from the center of the interior of the receiving slot 11. The upper side and the lower side of the receiving slot 11 each individually have a convex rib 13. The convex column has a through hole 14 passing through the front side and the rear side of the connecting base 10. On two sides of the receiving slot 11 individually there is an opening 15 (as shown in FIG. 5). The two openings 15 link with the receiving slot 11. There is a plurality of concave wedged slots disposed on the inner wall of the receiving slot having a continuous sawtooth shape, and there is a protruding portion 17 between two adjacent wedged slots 16.

On both the left side and the right side of the front surface of the connecting base 10 there is a concave slot 18. In the inner surface of the concave slot 18, there is a rib 181 and a first assembling portion 182. In this embodiment, the first assembling portion 182 is a plugging hole.

The two decorative boards 20 correspond to the two concave slots 18. The rear side of the decorative board 20 has a second assembling portion 21 that can be assembled with the first assembling portion 182. In this embodiment, the second assembling portion 21 is a plugging column.

The cover board 30 has a hole 31 that corresponds to the through hole 14 of the connecting base 10. The connecting base 10 and the cover board 30 respectively has a third assembling portion 19 and a fourth assembling portion 32 that can be assembled together. In this embodiment, the third assembling portion 19 is a plugging hole that is located on the rear surface of the connecting base 10, and the fourth assembling portion 32 is a plugging column that is located on the front surface of the cover board 30.

The fitting ring 40 has a left end portion 41 and a right end portion 42. The two end portions 41, 42 each have a long slot 43, 44. The left end portion 41 located on the upper side of the inner surface of the long slot 43 has an upper gear portion 45. The right end portion 42 located on the lower side of the inner surface of the long slot 44 has a lower gear portion 46.

The guiding part 50 includes a base portion 51, a gear 52, and a plurality of flexible arms 54. The gear 52 is located on the center of the rear surface of the base portion 51. The base portion 51 has a through hole 53. The through hole 53 corresponds to the convex column 12 of the connecting base 10, and passes through the rear surface of the gear 52.

The flexible arms 54 are formed by bending outwards and extending the base portion 51. The flexible arms 54 are arc shaped and are disposed on the surrounding edge of the base portion 51 at intervals. The cross location of the flexible arm 54 and the base portion 51 forms a bending portion 55.

The outer surface of the flexible arm 54 has a wedged body 541. The wedged body 541 corresponds to the wedged slot 16 of the connecting base 10. The end of the flexible arm 54 is a free end that extends slantedly forward towards the base portion 51 to form a pushing portion 56.

The adjustable part 60 is hollow. There is a plurality of convex edges 61 on the surrounding edge of the adjustable part 60 that can be pushed to rotate the adjustable part 60. A shaft portion 62 and a plurality of guiding columns 63 protrude from the center of the inner surface of the adjustable part 60 and face towards the guiding part 50. The shaft portion 62 corresponds to the through hole 14 of the convex column 12 of the connecting base 10, and the rear end of the shaft portion 62 has a screw hole 64. The guiding columns 63 and the flexible arms 54 are disposed on the shaft portion 62 in a radial direction.

When the present invention is assembled, the second assembling portion 21 of the two decorative boards 20 is assembled with the first assembling portion 182 of the connecting base 10, and the fourth assembling portion 32 of the cover board 30 is assembled with the third assembling portion 19 of the connecting base 10 (as shown in FIG. 5). Thereby, the two decorative boards 20 and the cover board 30 are respectively located on the front side and the rear side of the connecting base 10.

The two end portions 41, 42 of the fitting ring 40 respectively pass through the two openings 15 of the connecting base 10 and are stacked in the connecting base 10. The long slots 43, 44 of the two end portions 41, 42 are sleeved on the convex column 12, and the upper side and the lower side of the two end portions 41, 42 contact the two convex ribs 13.

Figure 6:
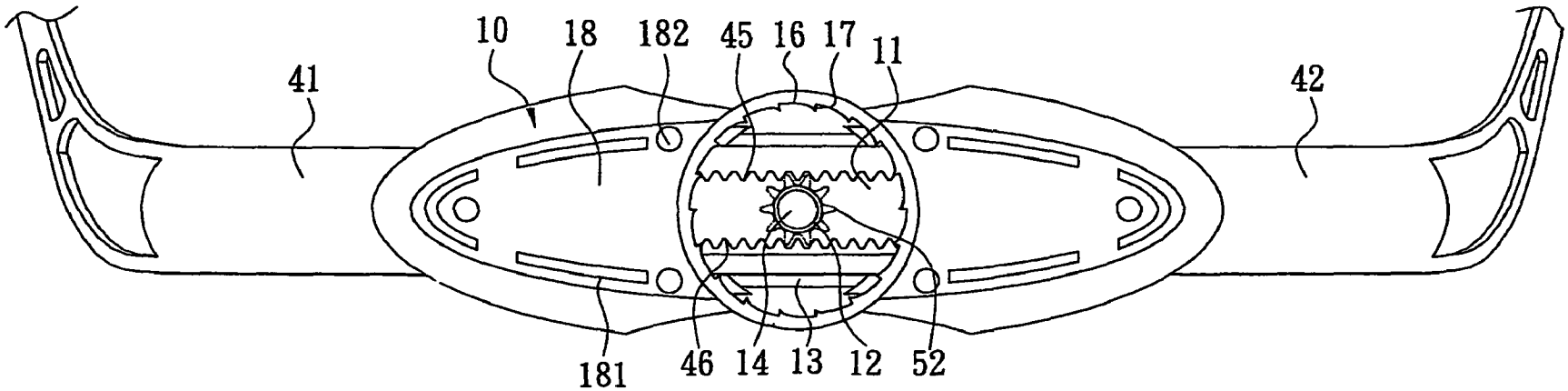
FIG. 6 is a schematic diagram of the gear gearing with the gear portion of the fitting ring of the present invention.

The guiding part 50 is received in the receiving slot 11. The wedged body 541 of the flexible arm 54 contacts and is connected with the inner wall of the wedged slot 16 of the receiving slot 11. The convex column 12 of the connecting base 10 is plugged into the through hole 53 of the guiding part 50 so that the guiding part 50 is pivoted with the connecting base 10. The gear 52 of the guiding part 50 extends into the long slots 43, 44 of the two end portions 41, 42. The upper and lower gear portions 45, 46 gear with the gear 52 and are located on the two opposite sides of the gear 52 (refer to FIG. 6)

The adjustable part 60 is located on one side of the guiding part 50. The guiding column 63 extends into the space formed by the bending portion 55, the flexible arm 54, and the pushing portion 56, and can move in the space so that the adjustable part 60 makes the guiding part 50 rotate. The shaft portion 62 of the adjustable part 60 passes through the through hole 14 of the connecting base 10 and the hole 31 of the cover board 30 in sequence and uses a locking element 70 (a screw) to screw into the screw hole 64 of the shaft portion 62. Thereby, the adjustable part 60 is pivoted with the connecting base 10. The cover board 30, the connecting base 10 and the adjustable part 60 are connected together via the locking element 70.

The present invention rotates the adjustable part 60 to make the guiding part 50 rotate so that the gear 52 move the upper and lower gear portions 45, 46 of the two end portions 41, 42 of the fitting ring 40. Thereby, the two end portions 41, 42 of the fitting ring 40 move in same direction or in different directions, and the dimension of the fitting ring 40 is adjusted.

Figure 7:
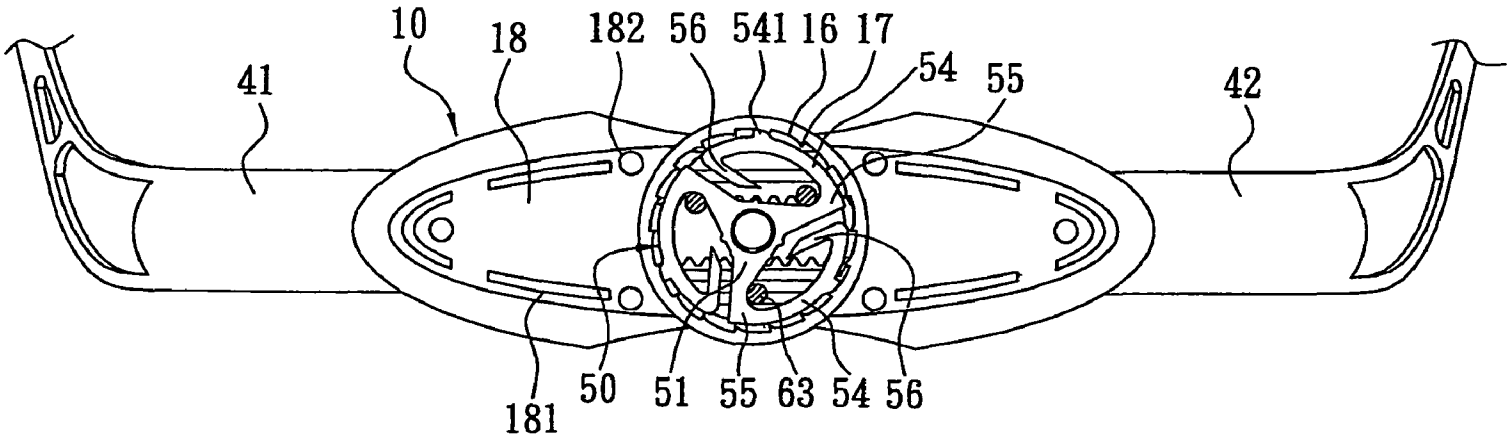
FIG. 7 is a cross-sectional view of the adjustable part of the present invention being rotated.

When the adjustable part 60 is rotating, the guiding column 63 leans against one side of the bending porting 55 of the guiding part 50 (as shown in FIG. 7). The adjustable part 60 makes the guiding part 50 rotate via fitting the guiding column 63 into the bending portion 55. At the same time, the protruding portion 17 in the receiving slot 11 contacts the wedged body 541 to make the flexible arm 54 deform forward towards the base portion 51 and the wedged body 541 crosses over the protruding portion 17 and enters into another wedged slot 16. By utilizing the recovery force provided by the flexible arm 54, the wedged body 541 pushes and contacts the inner wall of another wedged slot 16.

Figure 8:
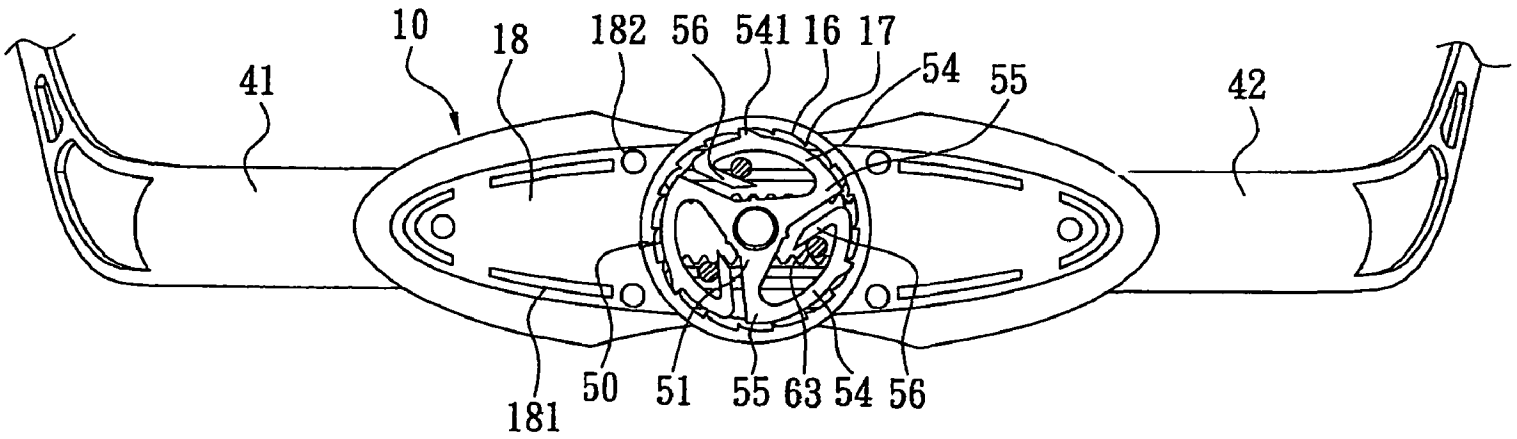
FIG. 8 is another cross-sectional view of the adjustable part of the present invention being rotated.

When the adjustable part 60 is rotating in a reverse direction, the guiding column 63 pushes and contacts one side of the pushing portion 56 (as shown in FIG. 8). The adjustable part 60 makes the guiding part 50 rotate in a reverse direction via fitting the guiding column 63 into the pushing portion 56. At the same time, the pushing portion 56 is pulled to make the flexible arm 54 move forward towards the base portion 51 and deform. Simultaneously, the wedged body 541, in a reverse direction, crosses over the protruding portion 17 and enters into another wedged slot 16. By utilizing the recovery force provided by the flexible arm 54, the wedged body 541 pushes and contacts the inner wall of another wedged slot 16.

When the adjustable part 60 is rotated, the wedged body 541 of the guiding part 50 contacts the wedged slots 16 of the receiving slot 11 in sequence thereby making multiple stepping sounds. After the adjustable part 60 has been adjusted, the guiding part 50 is positioned in the connecting base 10 by utilizing the wedged body 541 of the guiding part 50 to push and contact the wedged slot 16 of the connecting base 10.

The adjustable fitting ring structure uses the long slots 43, 44 of the end portions 41, 42 of the fitting ring 10 to sleeve the gear 52 to limit the movement of the two end portions 41, 42. Thereby, the end portions 41, 42 do not easily slip out and can firmly gear with the upper and lower gear portions 45, 46 and rotate smoothly.

The adjustable part 60 uses the guiding column 63 to rotate the guiding part 50, and the guiding part 50 has a flexible arm 54. By utilizing the flexible force of the flexible arm 54, the wedged body 541 of the guiding part 50 pushes and contacts the wedged slot 16 of the connecting base 10 in sequence thereby generating multiple stepping sounds and position the guiding part 50. Therefore, the dimension of the fitting ring 40 will not be changed. Wear and tear between the components is reduced. Even when the adjustable fitting ring structure has been used for a long time, it is still smooth.

The required components for the adjustable fitting ring structure are reduced. The assembling process is simple, and the cost is also reduced.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. An adjustable fitting ring structure, comprising:

a connecting base having a receiving slot, wherein two sides of the receiving slot each individually have an opening, the two openings link with the receiving slot, and there is a plurality of concave wedged slots disposed on an inner wall of the receiving slot, the receiving slot having an interior upper side and lower side respectively having a convex rib;

a fitting ring having two end portions, wherein each of the two end portions has a long slot, an upper side of the inner surface of the long slot located on the end portion has a gear portion, a lower side of the inner surface of the long slot located on another end portion has another gear portion, and the two end portions respectively pass through the openings and are stacked in the connecting base, two sides of the two end portions respectively contact and are connected with the two convex ribs;

a guiding part received in the receiving slot and pivoted on the connecting base, wherein the guiding part includes a base portion, a gear, and a plurality of flexible arms, the gear is located on one surface of the base portion and extends into the two long slots, the two gear portions gear with the gear and are located on the two opposite sides of the gear, a surface of the outer edge of the flexible arm has a wedged body to contact and connect with the wedged slot of the receiving slot, the base portion bends and extends to form the flexible arms, and the flexible arms are disposed at a surrounding edge of the base portion at intervals; and an adjustable part located on one side of the guiding part and pivoted on the connecting base, wherein the adjustable part makes the guiding part rotate so that the two end portions move in different directions.

2. The adjustable fitting ring structure as claimed in claim 1, wherein one side of the connecting base has at least one decorative board.

3. The adjustable fitting ring structure as claimed in claim 1, wherein one side of the connecting base has a cover board, and the cover board, the connecting base, and the adjustable part are connected together via a locking element.

4. The adjustable fitting ring structure as claimed in claim 1, wherein the connecting base has a through hole, the adjustable part has a shaft portion, and the shaft portion passes through the through hole.

5. The adjustable fitting ring structure as claimed in claim 1, wherein a convex column protrudes from the receiving slot, the guiding part has a through hole on the base portion, and the convex column is plugged into the through hole.

6. The adjustable fitting ring structure as claimed in claim 1, wherein the wedged slots have a continuous sawtooth shape.

7. The adjustable fitting ring structure as claimed in claim 1, wherein the flexible arm is arc shaped.

8. The adjustable fitting ring structure as claimed in claim 1, wherein a cross location between the base portion and the flexible arm forms a bending portion, and one end of the flexible arm is a free end and extends slantedly forward towards the base portion to form a pushing portion.

9. The adjustable fitting ring structure as claimed in claim 8, wherein the adjustable part has a plurality of guiding columns, the guiding columns extend into a space formed by the bending portion, the flexible arm, and the pushing portion.

* * * * *